US006453701B1

(12) United States Patent
Katz

(10) Patent No.: US 6,453,701 B1
(45) Date of Patent: Sep. 24, 2002

(54) MULTI-PART JEWELRY SETTING

(76) Inventor: David Katz, 2177 E. 65 St., Brooklyn, NY (US) 11234

( * ) Notice: Subject to any disclaimer, the term of this patent is extended or adjusted under 35 U.S.C. 154(b) by 80 days.

(21) Appl. No.: 09/754,761

(22) Filed: Jan. 4, 2001

Related U.S. Application Data

(60) Provisional application No. 60/204,293, filed on May 15, 2000.

(51) Int. Cl.[7] ..... A44C 17/02

(52) U.S. Cl. ..... 63/26; 63/27; 63/28; 63/29.1

(58) Field of Search ..... 63/26, 27, 28, 63/29.1, 30, 31

(56) References Cited

U.S. PATENT DOCUMENTS

| | | | | | |
|---|---|---|---|---|---|
| 1,442,815 | A | | 1/1923 | Maker et al. | |
| 2,510,774 | A | | 6/1950 | Engel | |
| 2,835,117 | A | * | 5/1958 | Lutrario | 63/15 |
| 4,258,458 | A | * | 3/1981 | Danna | 29/10 |
| 4,793,156 | A | * | 12/1988 | Pence | 63/26 |
| 5,188,679 | A | | 2/1993 | Kretchmer | |
| 5,433,090 | A | | 7/1995 | Santiago | |
| 5,687,586 | A | * | 11/1997 | Facini | 510/277 |
| 5,800,574 | A | | 9/1998 | Ricci et al. | |
| 6,003,335 | A | * | 12/1999 | Gurevich et al. | 63/26 |
| 6,260,384 | B1 | * | 7/2001 | Mino et al. | 63/26 |
| 6,293,129 | B1 | * | 9/2001 | Gurevich | 63/26 |
| 6,298,689 | B1 | * | 10/2001 | Lai | 63/26 |

* cited by examiner

*Primary Examiner*—Robert J. Sandy
*Assistant Examiner*—André L. Jackson
(74) *Attorney, Agent, or Firm*—Anthony J. Casella; Gerald E. Hespos

(57) ABSTRACT

A jewelry setting is provided to accommodate different shapes and sizes of gemstones. The multi-part jewelry setting comprises a gemstone holding means and a housing means for totally encasing a gemstone while affording substantial exposure of the gemstone. The U-shaped holding means is formed with a retaining means for engaging a peripheral edge of a gemstone and is formed to be resilient to accommodate gemstones of various diameters. By forming the gemstone holding means with a resilient material, the gemstone holding means will act like a spring and capture the gemstone by a compression fit. All of the components can be stamped from a single piece of sheet material. Being formed from sheet material, the completed housing is essentially hollow and results in an aesthetically pleasing, relatively inexpensive setting since less precious metal is required, even though, it appears to be of significant and massive precious metal construction.

32 Claims, 8 Drawing Sheets

MULTI-PART JEWELRY SETTING

This application claims the benefit of the filing date of Provisional Patent Application, U.S. Ser. No. 60/204,293, which was filed on May 15, 2000 and is entitled "MULTI-PART JEWELRY SETTING", the disclosure of which is incorporated herein by reference.

BACKGROUND OF THE INVENTION

1. Field of the Invention

The subject invention is directed to a jewelry setting made of a plurality of parts, and more particularly, to a gemstone setting employing a compression-type holding means to facilitate mounting of a gemstone, and is constructed of sheet material allowing ease of assembly and reduced material cost.

2. Description of the Prior Art

It is known in the jewelry art to make gemstone settings of various designs and constructions. One such setting is a prong-setting which includes a number of metal prongs or legs radiating from a base. After placing a gemstone in the setting, the jeweler bends the ends of the prongs over to hold the gemstone captive without unduly concealing the gemstone's surface. It is also known how to set gemstones by raising metal walls around a stone to secure it in position, such as in a bead-setting or bezel-setting.

While the settings described above work well for a specific cut of gemstone, a single setting cannot be adapted to accept varying types of gemstone cuts. Once a satisfying design is arrived at, the construction of the setting will have to be modified for each type of gemstone cut. For example, a jewelry setting designed to accommodate a round cut will have to be modified to accept a gemstone of an emerald or marquise cut. Therefore, depending on the manufacturing process, many different dies will have to be produced to accommodate the different holding means of the setting, or where the settings are constructed manually, various cuts of material will have to be readily available. This will result in increased labor and material costs making it undesirable to produce various settings in any large volume.

Even in a setting produced to accept only one kind of gemstone cut, considerable costs are expended in prior art jewelry settings, particularly for high-end settings. These high-end settings usually are constructed with a large quantity of precious metal, such as gold, silver or platinum, resulting in high cost. Also, due to the volume of precious metal, these settings must be cast, molded or worked resulting in many labor hours per setting. Additionally, since there may be variations in stones for one particular size, e.g. 4 mm, each individual setting would necessitate modifications prohibiting mass production of the setting.

Accordingly, it is an object of the present invention to provide a new and improved jewelry setting with a gemstone holding means to accommodate various sizes and types of gemstone cuts, e.g. round, oval, emerald, marquise, pear or princess.

It is another object of the subject invention to provide a jewelry setting in which the gemstone can be mounted easily to the setting without requiring modifications to the setting to accommodate variations in a particular stone size.

Another object of the subject invention is to provide a simple and easily constructed jewelry setting, the parts of which may be readily formed and easily assembled to form a substantial structure of attractive appearance.

It is still a further object of the subject invention to provide a jewelry setting which gives the appearance of massive precious metal construction while utilizing relatively inexpensive sheet material.

SUMMARY OF THE INVENTION

The above stated objects are met by a new and improved multi-part jewelry setting. The multi-part jewelry setting comprises a gemstone holding means and a housing means for totally encasing a gemstone while affording substantial exposure of the gemstone. The holding means is a generally U-shaped bracket formed with a retaining means near its ends for engaging a peripheral edge of a gemstone. The U-shaped holding bracket is formed to be resilient to accommodate gemstones of various diameters within a particular class of stone size.

The housing means comprises a plurality of U-shaped brackets and is assembled to encase the holding means in the following manner. A second and larger U-shaped top bracket with open sides is soldered within the gemstone holding means in a base-to-base relationship. The upper ends of the second U-shaped top bracket are bent outwardly at an acute angle to form a retaining shelf. The second U-shaped top bracket is then disposed within a third and even larger U-shaped bottom bracket. The bottom bracket will support the gemstone holding means by having its upper ends come into contact with the retaining shelf of the second U-shaped top bracket. The housing means is then enclosed by two, flat U-shaped side walls which are sized to equal the difference in widths between the second U-shaped top bracket and the third U-shaped bottom bracket.

By forming the gemstone holding means with a resilient material, the gemstone holding means will act like a spring and capture the gemstone by a compression fit. In mounting the gemstone, the multi-part jewelry setting will be placed in a holder with its housing coming into contact with the holder to firmly hold the setting and its upper ends pointing in an upward vertical direction to receive the gemstone. The gemstone will then be inserted into the gemstone holding means with the bottom surface of the gemstone directed toward the base of the jewelry setting. As pressure is applied on the top surface of the gemstone in a vertically downward direction, the upper ends of the holding means will begin to flex outward as the gemstone slides into the setting. The gemstone will continue to slide into the setting until the retaining means of the holding means engage a peripheral edge of the gemstone and the upper ends of the holding means snap inward giving a positive indication that the gemstone is set. The flexibility of the holding means allows the multi-part jewelry setting to accommodate gemstones of varying diameters and eliminates the need to custom make a setting for a particular gemstone.

All of the components of the multi-part jewelry setting are of a uniform thickness and therefore can be stamped from a single piece of sheet material. This material can be any metal having resilient characteristics, and preferably will be a precious metal, such as gold, silver or platinum. In large scale production, it can be appreciated that numerous components can be stamped at once with a single piece of material thus avoiding waste and increasing productivity. Once stamped, the individual components can be machined into their proper shape for assembly.

Since the multi-part jewelry setting is formed from sheet material, the completed housing is essentially hollow. This results in an aesthetically pleasing, relatively inexpensive setting since less precious metal is required, even though, it appears to be of significant and massive precious metal construction. Once assembled, the setting can be easily fitted to be used in connection with finger rings, earrings, bracelets and pendants.

These and other features of the present invention will become apparent from the following detailed description considered in connection with the accompanying drawings. It should be understood, however, that the drawings are designed for the purpose of illustration only and not as a definition of the limits of the invention.

DETAILED DESCRIPTION OF THE PREFERRED EMBODIMENTS

Referring to the FIGS., a new and improved jewelry setting 10 is provided for different shapes and sizes of gemstones. The jewelry setting 10 is made of a plurality of parts which, when assembled, provide an aesthetically pleasing setting that appears to be of significant and massive precious metal construction. In fact, the setting 10 is hollow and is relatively inexpensive as compared to its appearance which is expensive looking.

Figure 1:
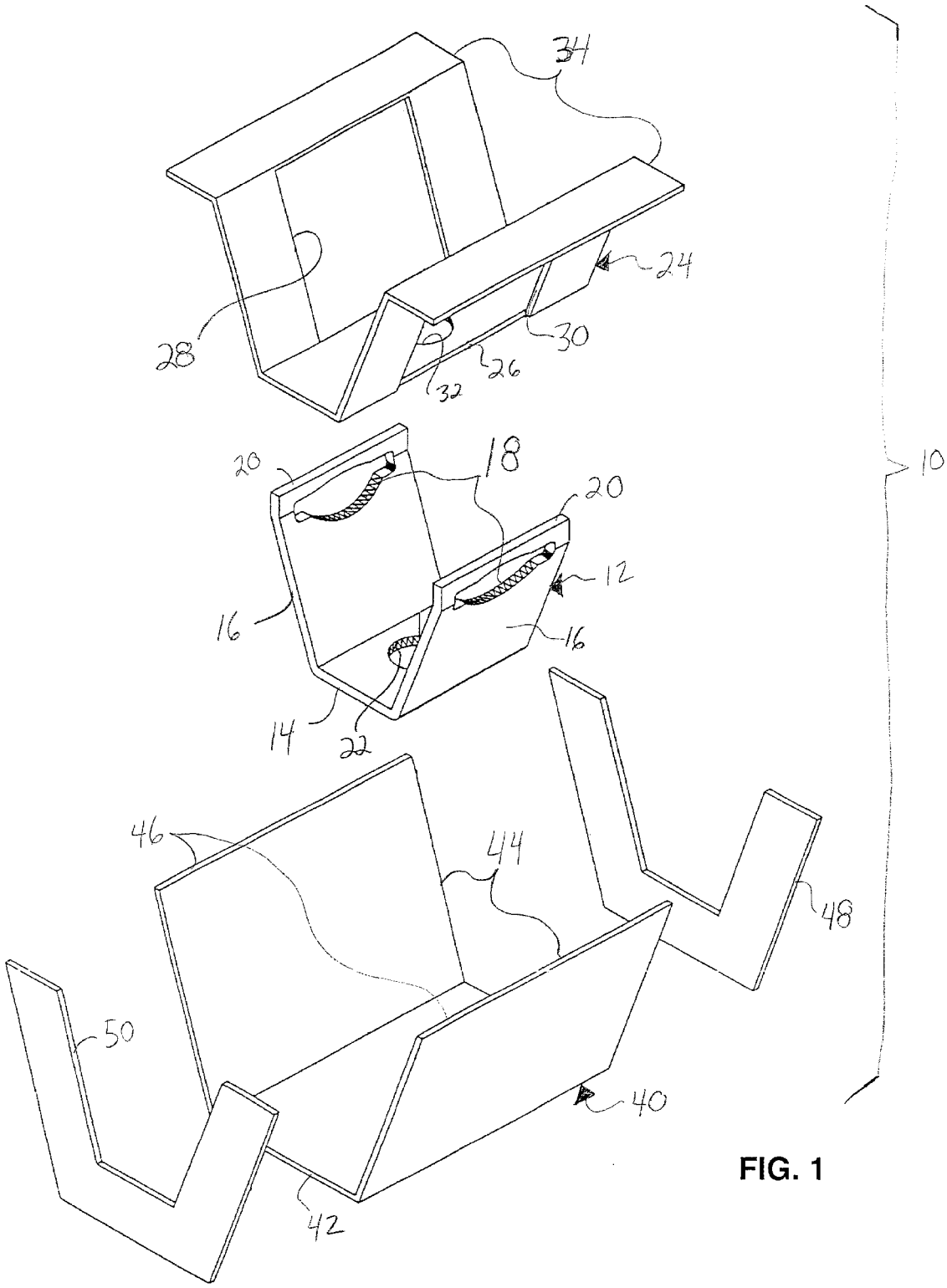
FIG. 1 is an exploded perspective view of a first embodiment of the multi-part jewelry setting of the subject invention.
Figure 2:
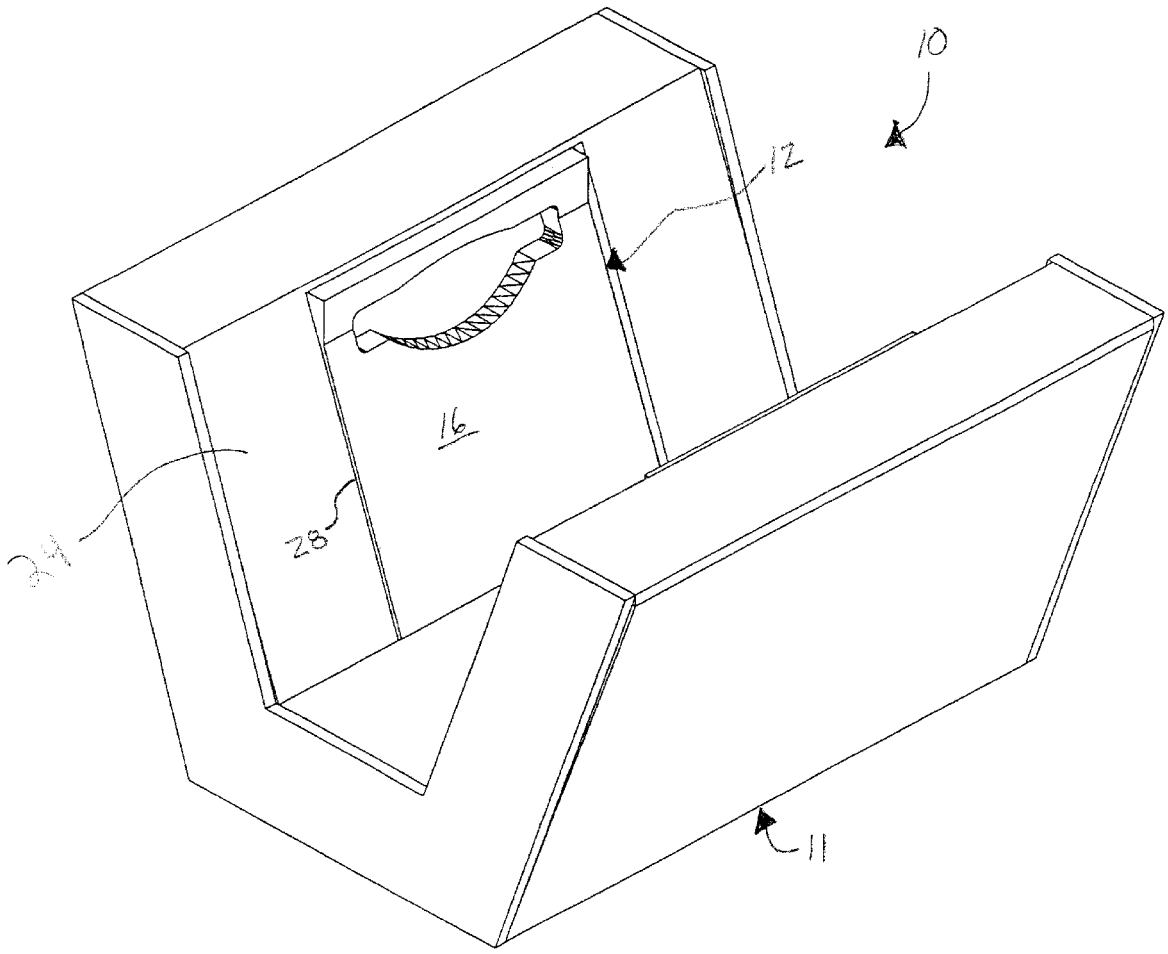
FIG. 2 is the assembled multi-part jewelry setting of FIG. 1.

Referring to FIGS. 1 and 2, the multi-part jewelry setting 10 comprises a gemstone holding means 12 and a housing means 11. The holding means is a generally U-shaped holding bracket l2 which includes a base 14 and two upstanding walls 16. The base 14 further comprises an aperture 22 for receiving a lower end of a gemstone, which will be described below. The U-shaped holding bracket 12 is formed with horizontal slots 18 as the retaining means near its ends 20 for engaging a peripheral edge of a gemstone, with each end 20 slightly bent inward at the axis of the slots.

The U-shaped holding bracket 12 is formed to be resilient to accommodate gemstones of various diameters within a particular class of stone size. Once worked into its "U" shape, the gemstone holding means 12 is heat-treated and age-hardened in an oven for a predetermined amount of time at a specific temperature. The temperature of the oven and duration of time of this process will depend on the material used. For example, when using gold, the gemstone holding means 12 is heat-treated and age-hardened in an oven at 600° F. for two hours. This process increases the yield strength of the holding means 12 to create a spring pressure between the upper ends 20 of the bracket 12. The holding bracket 12 will then act as a compression spring when a gemstone of a diameter slightly larger than the distance between the upper ends 20 is inserted into the bracket 12. Due to its spring-like characteristics, the upstanding walls 16 will flex outward to accept variations in gemstone diameter, while the compression action will force the walls 16 inward to retain the gemstone.

The housing means 11 comprises a plurality of U-shaped brackets which are assembled to encase the holding means in the following manner. A second and larger U-shaped top bracket 24, with base 26 and open sides 28,30, is soldered within the gemstone holding means 12 in a base-to-base relationship. The base 26 of the second U-shaped top bracket 24 also includes an aperture 32 formed similar to aperture 22 and substantially the same size. The upper ends 34 of the second U-shaped top bracket 24 are bent outwardly at an acute angle to form a retaining shelf. The second U-shaped top bracket 24 is then disposed within a third and even larger U-shaped bottom bracket 40. The bottom bracket 40 is formed similarly to the above described brackets to include a base 42 and two upstanding walls 44. The bottom bracket 40 will support the gemstone holding means 12 by having its upper ends 46 come into contact with the retaining shelf 34 of the second U-shaped top bracket 24. The housing means 11 is then enclosed by two, flat U-shaped side walls 48, 50 which are sized to equal the difference in widths between the second U-shaped bracket 24 and the third U-shaped bottom bracket 40.

Before assembling the individual components of the jewelry setting 10, each components is prepared with a small amount of solder on all surfaces that come into contact with other components. The components are then put together in the manner described above to resemble the finished assembly 10 as shown in FIG. 2. The assembled components are then placed in an oven at a high enough temperature to allow the solder to reflow. The reflowing solder will permanently bond the components together except for the upstanding walls 16 of the gemstone holding means 12 which will be allowed to flex within the open sides 28, 30 of the second U-shaped top bracket 24.

Figure 3A:
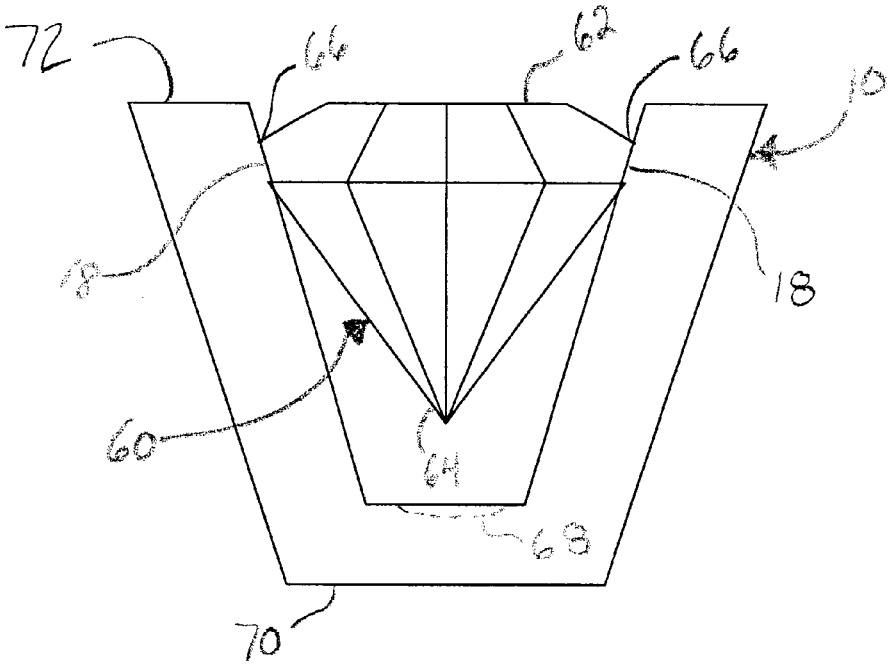
FIG. 3A is a side elevational view of the first embodiment of the multi-part jewelry setting of the subject invention with a round cut gemstone mounted in the gemstone holding means.
Figure 3B:
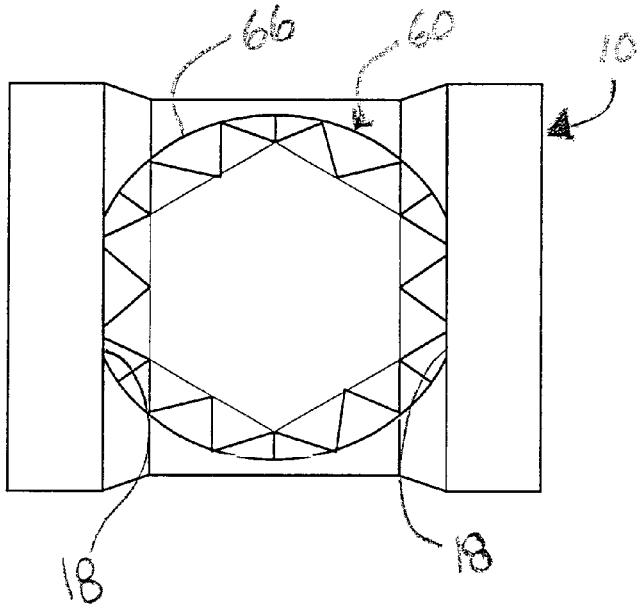
FIG. 3B is a top plan view of the first embodiment of the multi-part jewelry setting of the subject invention with a round cut gemstone mounted in the gemstone holding means.

By forming the gemstone holding means 12 with a resilient material, the gemstone holding means 12 will act like a spring and capture the gemstone by a compression fit in the setting 10 as shown in FIGS. 3A and 3B. In mounting the gemstone 60, the multi-part jewelry setting 10 will be placed in a holder with its base 70 coming into contact with the holder to firmly hold the setting and its upper ends 72 pointing in an upward vertical direction to receive the gemstone 60. The gemstone 60 will then be inserted into the gemstone holding means 12 with the bottom surface 64 of the gemstone directed toward the base 70 of the jewelry setting. For larger gemstones 60, the bottom surface 64 of the gemstone will be received by an aperture 68 (shown in phantom in FIG. 3A) formed from aperture 22 of the holding means 12 and aperture 32 of the second U-shaped top bracket 24.

As pressure is applied on the top surface 62 of the gemstone 60 in a vertically downward direction, the upper ends 20 of the holding means 12 will begin to flex outward as the gemstone slides into the setting. The gemstone 60 will continue to slide into the setting 10 until the slots 18 of the holding means engage a peripheral edge 66 of the gemstone 60 and the upper ends 20 of the holding means snap inward giving a positive indication that the gemstone is set. The flexibility of the holding means allows the multi-part jewelry setting to accommodate gemstones of varying diameters and eliminates the need to custom make a setting for a particular gemstone. Additionally, the upper ends 20 of the holding means 12 are bent slightly inward to assist the holding means in retaining the gemstone.

Figure 4:
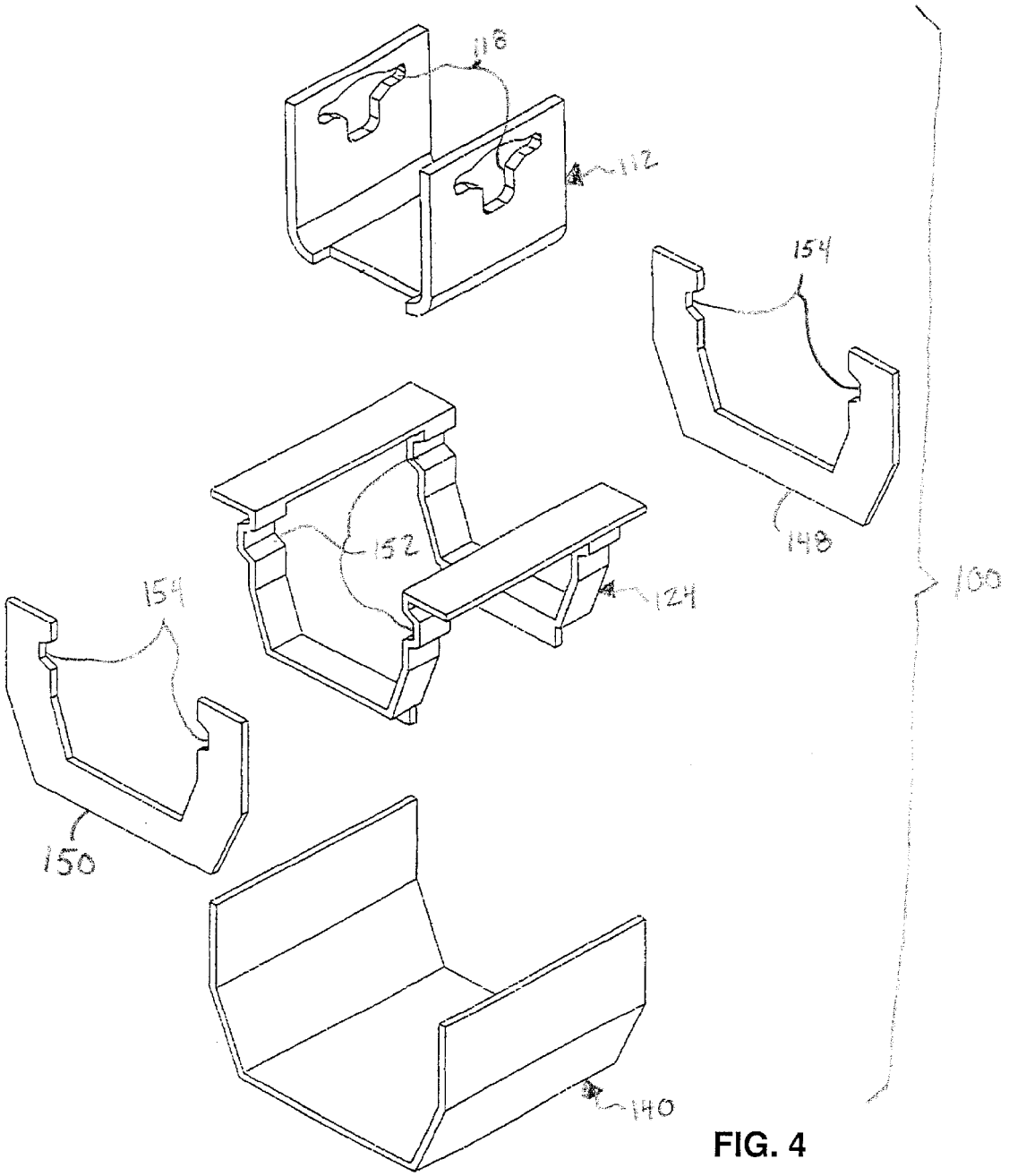
FIG. 4 is an exploded perspective view of a second embodiment of the multi-part jewelry setting of the subject invention.
Figure 5:
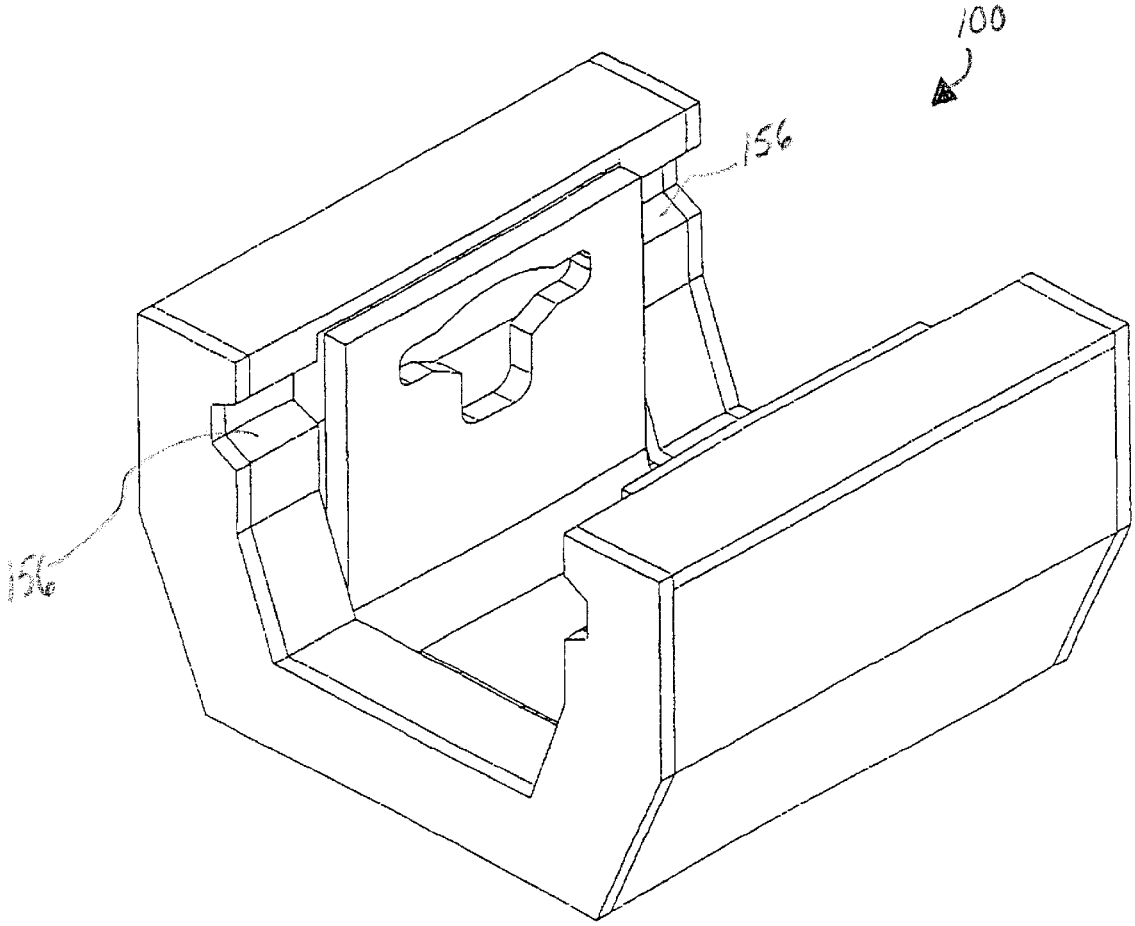
FIG. 5 is the assembled multi-part jewelry setting of FIG. 4.

FIGS. 4 and 5 illustrate a second embodiment of the subject multi-part jewelry setting 100. The second embodiment 100 is formed from the same number of parts and in a similar fashion to the first embodiment 10 of the subject jewelry setting. In this embodiment, the second U-shaped top bracket 124 and the two side walls 148,150 are formed with corresponding notches 152, 154 respectively, to form a ridge 156 which runs the length of the assembled setting 100. This ridge 156 is formed to accommodate longer cut gemstones, such as emerald, marquise, pear, oval, etc., as compared to a round cut gemstone. In all other aspects, such as, stamping the components, assembling and mounting the gemstones, the second embodiment 100 is identical to the first embodiment 10 of the subject jewelry setting.

Figure 6:
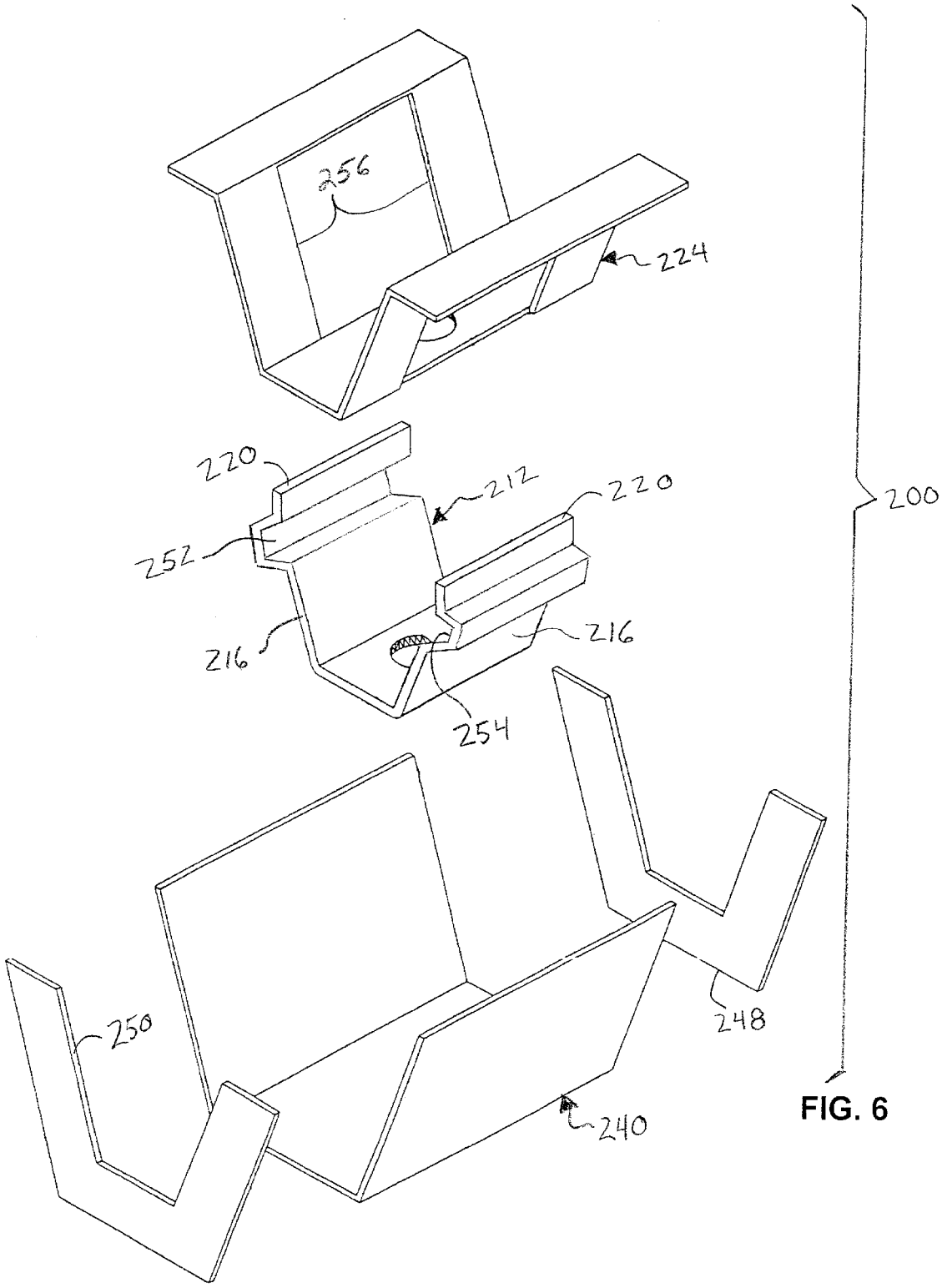
FIG. 6 is an exploded perspective view of a third embodiment of the multi-part jewelry setting of the subject invention.
Figure 7:
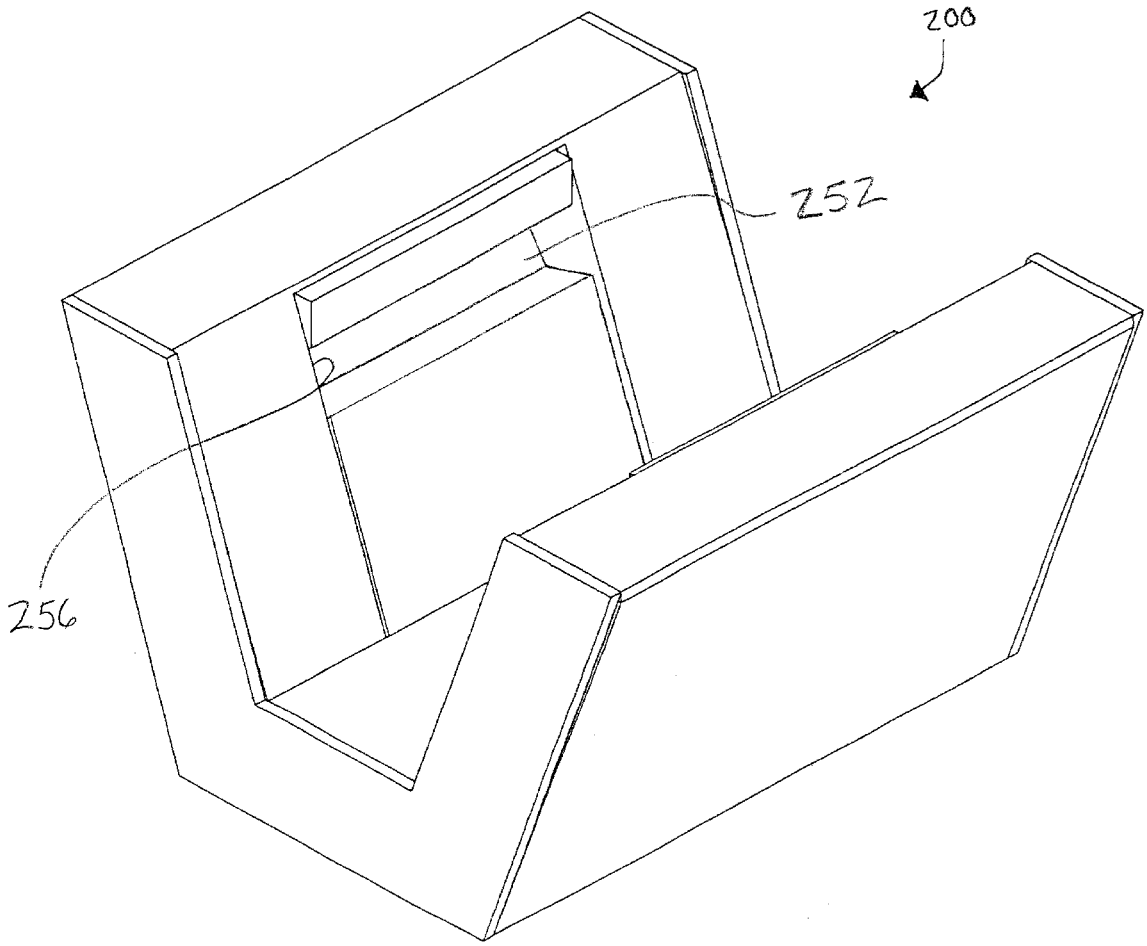
FIG. 7 is the assembled multi-part jewelry setting of FIG. 6.
Figure 8:
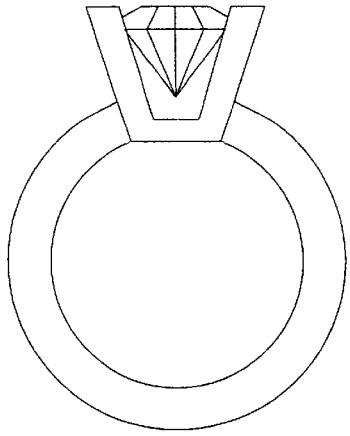
FIG. 8 is a top plan view of a finger ring employing the first embodiment of the multi-part jewelry setting of the subject invention.
Figure 9:
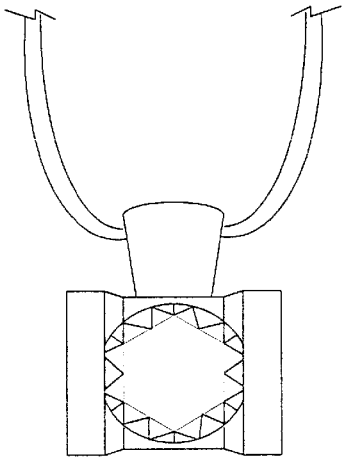
FIG. 9 is a front elevational view of a pendant employing the first embodiment of the multi-part jewelry setting of the subject invention.
Figure 10:
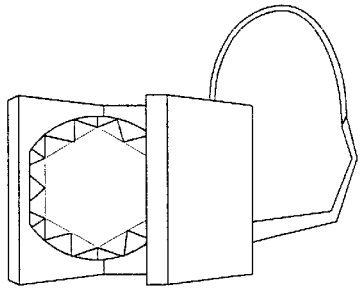
FIG. 10 is a side view of an earring employing the first embodiment of the multi-part jewelry setting of the subject invention.
Figure 11:
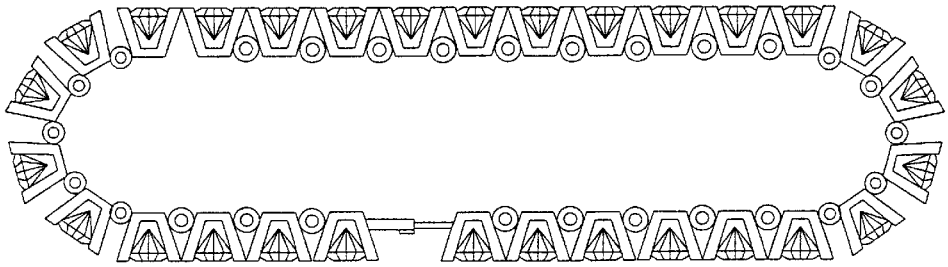
FIG. 11 is a top plan view of a bracelet employing the first embodiment of the multi-part jewelry setting of the subject invention.

FIGS. 6 and 7 illustrate a third embodiment of the subject multi-part jewelry setting 200. The third embodiment 200 is formed from the same number of parts and in a similar fashion to the first embodiment 10 of the subject jewelry setting. In this embodiment, the retaining means of the gemstone holding means 212 is formed by channels 252,254 in the upper ends 220 which run the length of the upstanding walls 216. The channels 252,254 are formed to accommodate square cut gemstones as compared to round cut gemstones. Two opposing, peripheral edges of a square cut gemstone will be captured by the channels 252,254 to prevent vertical movement of the stone. The edge 256 of the open sides of the second U-shaped top bracket 224 will prevent horizontal movement of the stone thereby locking the stone in place. In all other aspects, such as, stamping the components, assembling and mounting the gemstones, the third embodiment 200 is identical to the first embodiment 10 of the subject jewelry setting.

All of the components of the multi-part jewelry setting 10,100,200 are of a uniform thickness and therefore can be stamped from a single piece of sheet material. This material can be any metal having resilient characteristics, and preferably will be a precious metal, such as gold, silver or platinum. In large scale production, it can be appreciated that numerous components can be stamped at once with a single piece of material thus avoiding waste and increasing productivity. Once stamped, the individual components can be machined into their proper shape for assembly.

Since the multi-part jewelry setting 10 is formed from sheet material, the completed housing 11 is essentially hollow. This results in an aesthetically pleasing, relatively inexpensive setting since less precious metal is required, even though, it appears to be of significant and massive precious metal construction. Once assembled, the setting can be easily fitted to be used in connection with finger rings, earrings, bracelets and pendants, as shown in FIGS, 8–11.

As is readily apparent, numerous modifications and changes may readily occur to those skilled in the art, and hence it is not desired to limit the invention to the exact construction and operation shown and described. Accordingly, all suitable modification equivalents may be resorted to falling within the scope of the invention as claimed.

What is claimed is:

1. A jewelry setting for gemstones of various sizes and shapes, said jewelry setting comprising:

a holding means for fixedly retaining a gemstone; and a housing means for totally encasing said holding means while affording substantial exposure of said gemstone, said housing means comprising:

a U-shaped top bracket, said top bracket including a base and two upstanding walls, the upper end of each said upstanding wall being bent outwardly at an angle to form a retaining shelf, said walls of said U-shaped top bracket have openings through which said gemstone extends;

a U-shaped bottom bracket, said bottom bracket including a base and two upstanding walls, the upper free end of each said wall of said bottom bracket being in engagement with a retaining shelf of said top bracket; and two flat U-shaped side walls, said side walls extending between said U-shaped top bracket and said bottom bracket whereby said top bracket, said bottom bracket and said side walls fully enclose said housing means.

2. A jewelry setting as in claim 1, wherein said holding means is a U-shaped holding bracket, said holding bracket includes a base and two upstanding walls, said walls include a retaining means for engaging a peripheral edge of said gemstone.

3. A jewelry setting as in claim 2, wherein said holding bracket, said U-shaped top bracket, said bottom bracket and said side walls are of a uniform thickness.

4. A jewelry setting as in claim 2, wherein said U-shaped top bracket is coupled to said holding bracket in a base-to-base relationship.

5. A jewelry setting as in claim 2, wherein said holding means is formed from a resilient metal.

6. A jewelry setting as in claim 5, wherein said resilient metal is chosen from the group consisting of gold, silver and platinum.

7. A jewelry setting as in claim 5, wherein said retaining means are channels.

8. A jewelry setting as in claim 7, wherein said channels are positioned horizontal relative to said base of said holding bracket.

9. A jewelry setting as in claim 5, wherein said retaining means are slots.

10. A jewelry setting as in claim 9, wherein said slots are positioned horizontal relative to said base of said holding means.

11. A jewelry setting as in claim 10, wherein said upstanding walls of said holding bracket are bent inward at the axis of the horizontal slots.

12. A jewelry setting as in claim 11, wherein said base of said holding bracket further comprises an aperture for accommodating a bottom surface of a large gemstone.

13. A jewelry setting as in claim 12, wherein said base of said U-shaped top bracket further comprises an aperture for accommodating a bottom surface of said large gemstone.

14. A jewelry setting as in claim 13, wherein said upstanding walls of said U-shaped top bracket and said side walls further comprise corresponding notches to form a ridge in said jewelry setting to accommodate said peripheral edge of said gemstone.

15. A jewelry setting for gemstones of various sizes and shapes, said jewelry setting comprising:

a U-shaped holding bracket for fixedly retaining a gemstone, said holding bracket includes a base and two upstanding walls, said walls include slots for engaging a peripheral edge of said gemstone; and a housing for totally encasing said holding bracket while affording substantial exposure of said gemstone, said housing includes:

a U-shaped top bracket, said top bracket including a base and two upstanding walls, the upper end of each said upstanding wall being bent outwardly at an angle to form a retaining shelf, said walls of said U-shaped top bracket have openings through which said gemstone extends;

a U-shaped bottom bracket, said bottom bracket including a base and two upstanding walls, the upper free end of each said wall of said bottom bracket being in engagement with a retaining shelf of said top bracket; and two flat U-shaped side walls, said side walls extending between said U-shaped top bracket and said bottom bracket whereby said top bracket, said bottom bracket and said side walls fully enclose said housing means.

16. A jewelry setting as in claim 15, wherein said holding bracket, said U-shaped top bracket, said bottom bracket and said side walls are of a uniform thickness.

17. A jewelry setting as in claim 15, wherein said U-shaped top bracket is coupled to said holding bracket in a base-to-base relationship.

18. A jewelry setting as in claim 15, wherein said holding means is formed from a resilient metal.

19. A jewelry setting as in claim 18, wherein said resilient metal is chosen from the group consisting of gold, silver and platinum.

20. A jewelry setting as in claim 18, wherein said slots are positioned horizontal relative to said base of said holding means.

21. A jewelry setting as in claim 20, wherein said upstanding walls of said holding bracket are bent inward at the axis of the horizontal slots.

22. A jewelry setting as in claim 21, wherein said base of said holding bracket further comprises an aperture for accommodating a bottom surface of a large gemstone.

23. A jewelry setting as in claim 22, wherein said base of said U-shaped top bracket further comprises an aperture for accommodating a bottom surface of said large gemstone.

24. A jewelry setting as in claim 23, wherein said upstanding walls of said U-shaped top bracket and said side walls further comprise corresponding notches to form a ridge in said jewelry setting to accommodate said peripheral edge of said gemstone.

25. A jewelry setting for gemstones of various sizes and shapes, said jewelry setting comprising:

a U-shaped holding bracket for fixedly retaining a gemstone, said holding bracket includes a base and two upstanding walls, said walls include channels for engaging a peripheral edge of said gemstone; and a housing for totally encasing said holding bracket while affording substantial exposure of said gemstone, said housing includes:

a U-shaped top bracket, said top bracket including a base and two upstanding walls, the upper end of each said upstanding wall being bent outwardly at an angle to form a retaining shelf, said walls of said U-shaped top bracket have openings through which said gemstone extends;

a U-shaped bottom bracket, said bottom bracket including a base and two upstanding walls, the upper free end of each said wall of said bottom bracket being in engagement with a retaining shelf of said top bracket; and two flat U-shaped side walls, said side walls extending between said U-shaped top bracket and said bottom bracket whereby said top bracket, said bottom bracket and said side walls fully enclose said housing means.

26. A jewelry setting as in claim 25, wherein said holding bracket, said U-shaped shaped top bracket, said bottom bracket and said side walls are of a uniform thickness.

27. A jewelry setting as in claim 25, wherein said U-shaped top bracket is coupled to said holding bracket in a base-to-base relationship.

28. A jewelry setting as in claim 25, wherein said holding means is formed from a resilient metal.

29. A jewelry setting as in claim 28, wherein said resilient metal is chosen from the group consisting of gold, silver and platinum.

30. A jewelry setting as in claim 28, wherein said channels are positioned horizontal relative to said base of said holding means.

31. A jewelry setting as in claim 30, wherein said base of said holding bracket further comprises an aperture for accommodating a bottom surface of a large gemstone.

32. A jewelry setting as in claim 31, wherein said base of said U-shaped top bracket further comprises an aperture for accommodating a bottom surface of said large gemstone.

* * * * *